US005259227A

United States Patent [19]

Jacobson

[11] Patent Number: 5,259,227

[45] Date of Patent: Nov. 9, 1993

[54] CHUCK SET-UP FOR SPRING COILING MACHINE

[75] Inventor: John D. Jacobson, Southington, Conn.

[73] Assignee: Newcomb Spring Corporation, Southington, Conn.

[21] Appl. No.: 876,051

[22] Filed: Apr. 28, 1992

Related U.S. Application Data

[62] Division of Ser. No. 771,631, Oct. 4, 1991, Pat. No. 5,131,251.

[51] Int. Cl.[5] ..... B21F 3/02

[52] U.S. Cl. ..... 72/140; 72/135; 72/481

[58] Field of Search ..... 70/140, 141, 142, 143, 70/144, 145, 135, 137, 138, 139, 133, 481, 477, 480; 140/124; 403/361, 362, 354; 279/149, 152, 154, 155, 156, 902, 83

[56] References Cited

U.S. PATENT DOCUMENTS

| | | | |
|---|---|---|---|
| 1,761,739 | 6/1930 | Nigro | 72/135 |
| 1,885,089 | 10/1932 | Dukes | 279/83 |
| 2,119,002 | 5/1938 | Bergevin et al. | 72/138 |
| 2,287,882 | 6/1942 | Huff | 279/83 |
| 2,421,987 | 6/1947 | Braden | 72/481 |
| 3,342,052 | 9/1967 | Boy | 72/477 |
| 4,172,341 | 10/1979 | Klein, Sr. | 279/83 |
| 4,575,277 | 3/1986 | Dickey et al. | 403/361 |
| 4,798,072 | 1/1989 | Vanmeggelen et al. | 72/138 |
| 4,982,632 | 1/1991 | Barmore | 279/83 |

*Primary Examiner*—Lowell A. Larson
*Assistant Examiner*—Michael J. McKeon
*Attorney, Agent, or Firm*—Chilton, Alix & Van Kirk

[57] ABSTRACT

A chuck and arbor apparatus for a spring coiling machine implements an accurate alignment of the block wire guide with the feed line guides from the wire supply rolls. The chuck is modified to provide for discrete, axial clamping positions which correspond to selected wire alignment positions. The arbor is preferably D-shaped to establish a repeatable angular orientation in the chuck, and avoid the need to clamp the arbor while clamping the chuck.

3 Claims, 3 Drawing Sheets

CHUCK SET-UP FOR SPRING COILING MACHINE

This is a divisional of copending application Ser. No. 07/771,631 filed Oct. 4, 1991 now U.S. Pat. No. 5,131,251.

BACKGROUND OF THE INVENTION

This invention relates generally to spring coiling machines which form springs in an automated process. More particularly, the present invention relates to spring coiling machines which are capable of selectively feeding wire from multiple feed rolls for a given machine.

The basic construction and operating principles for spring coiling machines to which the invention relates are conventional and generally parallel those set forth in representative U.S. Pat. No. 2,119,002 issued on May 31, 1938, for "Spring Coiling Machine" and U.S. Pat. No. 2,831,570, issued on Apr. 22, 1958 for "Wire Coiling Machine Having Cams for Holding the Feed Rolls Separated". The coiling machine described in U.S. Pat. No. 2,119,002 has various features which permit the operator to adjust the settings and cam-controlled movement of various tools and devices that determine the ultimate characteristics of the fabricated coil springs. The machine conventionally employs a tool holder or chuck. The chuck mounts an arbor as well as a block wire guide.

The conventional wire coiling machines to which the invention relates may have multiple feed rolls which supply wire of various diameters or qualities. For a given work order, a wire having pre-established diameter or quality is selected and the wire is fed along a path from the selected feed roll to the wire block guide. An arbor, which is mounted in the chuck, extends outwardly from the plane of the front panel of the machine. A coiling point contacts the wire as it emerges between the arbor and the block guide and deformably bends the wire into a generally helical shape.

In conventional coiling machines for which the invention represents an improvement, the machine is set up by first fixing the block guide to the chuck through a bore or opening provided for this purpose. Generally, the block guide has only one fixed position with respect to the chuck. The chuck is generally made of two pieces, with the opening for receiving the arbor being split by the mating surfaces of the two pieces. Generally, the arbor is inserted in the split opening and "eyeballed" relative to the block guide. The chuck with arbor and block guide is inserted through an opening provided in the panel near the coiling point, between clamps located immediately behind the panel. While the split chuck is still relatively loosely held in the panel, the operator must adjust the arbor at least rotationally and sometimes axially relative to the chuck, and adjust the chuck axially so that, upon clamping of the chuck, the block guide is in alignment with the particular wire to be utilized, and the arbor is properly positioned axially and aligned rotationally relative to the chuck. The arbor is secured in place as a result of the clamping of the chuck whereby the mating surfaces at the split line are urged toward each other thereby also clamping the arbor in the split opening.

This conventional procedure is quite time-consuming, especially when the set-up time is compared with production time for a short run. For longer runs, the arbor deteriorates and must be replaced or more typically reformed in order to maintain optimum performance. Conventionally, arbor replacement or repair required removal of the chuck from the machine. Thus, all the adjustment steps discussed in the preceeding paragraph would be required whether setting up the machine initially, or merely for repairing an arbor during a production run.

SUMMARY OF THE INVENTION

The present invention is directed to a novel chuck and arbor, which can be utilized in a conventional coiling machine along with a conventional block guide, to more quickly set up the machine, and replace or adjust the arbor after the machine has been set up.

One aspect of the invention is directed to a chuck having a substantially "D" shaped opening for receiving an arbor having a substantially complementary "D" solid cross section for mating with the D-shaped opening. This "D" or similarly irregular cross section defines a unique orientation of the arbor relative to the chuck, which can be implemented whether or not the chuck is clamped and placed in the panel. Preferably, the axial positioning of the arbor is independently adjusted by a set screw or the like passing through the chuck transversely toward the axis of the arbor, and accessible from the front of the panel when the chuck is clamped in place.

In another aspect of the invention, the spring coiling machine chuck is provided with a plurality of grooves which are axially spaced a pre-established spacing which ensures proper alignment of the block guide with the feed roll wire guides. The split V-shaped clamp mechanism which clamps the chuck in fixed position is provided with tongues which mate with a selected groove to thereby establish the axial position of the chuck. The axial position of the chuck defines the optimal aligned position of the mounted block wire guide for a given selected feed roll. Consequently, an optimal alignment of the block wire guide with the selected feed guide can be implemented in a very efficient and accurate manner.

In an alternative embodiment of the invention, a plurality of openings are formed in a side surface of the chuck. The openings each have a pre-established spacing which corresponds to the axial spacing of one of the feed roll wire guides. A stop in the form of a pin or block is inserted into a selected opening. The stop engages a panel or other structure of the coiling machine to define a pre-established axial position of the chuck and thereby accurately align the mounted block wire guide with the selected wire guide.

In another embodiment of the invention, an adjustable stop may be affixed to one side of the chuck. The stop is adjustable to provide a pre-established axial position of the chuck and thereby define the wire alignment for the block wire guide.

Thus, an object of the invention is to provide a new and improved chuck for a spring coiling machine.

Another object of the invention is to provide a new and improved wire alignment apparatus which efficiently implements an accurate alignment of the block wire guide with the feed roll wire guides.

A further object of the invention is to provide a new and improved chuck and arbor for a spring coiling machine wherein the arbor may essentially be independently adjusted within the chuck.

Other objects and advantages of the invention will become apparent from the specification and the drawings.

DETAILED DESCRIPTION OF THE PREFERRED EMBODIMENTS

With reference to the drawings wherein like numerals represent like parts throughout the several figures, a spring coiling machine for which the invention is particularly adapted is generally designated by the numeral 10. Spring coiling machine 10 may be any of numerous makes and models which are employed for manufacturing coil springs in an automatic highly efficient process. A preferred embodiment which is employed for describing the present invention is a single point spring coiling machine such as the Model W-11A springmaker marketed by the Torin Corporation of Torrington, Conn. It should be understood that the principles and advantages of the invention are applicable to other makes of coiling machines. The basic operating features and principles of the Torin machines are described in U.S. Pat. No. 2,119,002, the disclosure which is hereby incorporated by reference.

The spring coiling machine 10 employs a multiplicity of gears, linkages, levers, cams and power supplies, all of which are operatively integrated for the purposes of feeding a wire W through to a coiling station 20. The wire W is plastically deformed at the coiling station into a coil spring S having desired characteristics such as diameter, length and pitch which may vary for a given coil. The coil spring S is then severed from the supply wire. The manufacturing sequence is continuously replicated so that multiple coil springs are produced without any interruption in a highly efficient manufacturing process.

Figure 1:
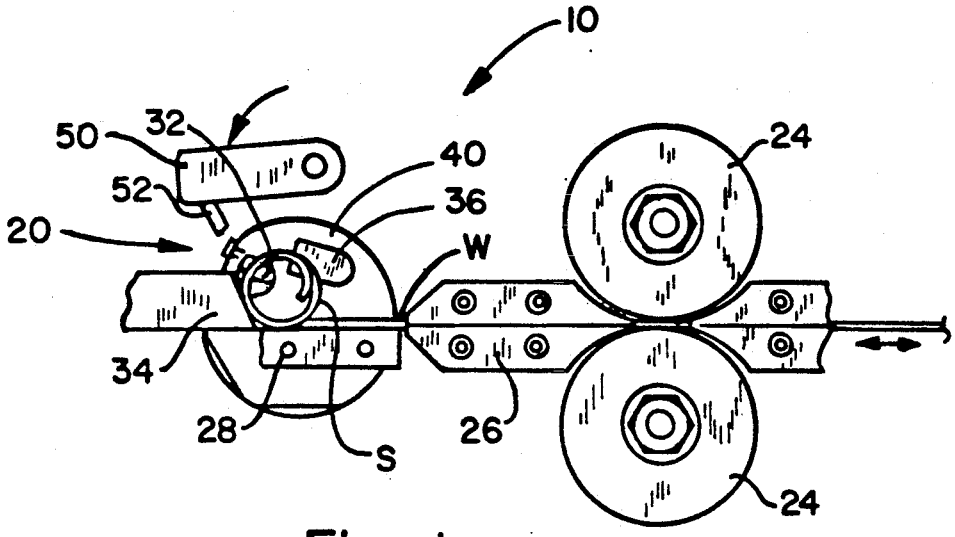
FIG. 1 is a fragmentary frontal view, partly broken away and partly in phantom, of a spring coiling machine incorporating the wire alignment apparatus of the present invention.

The coiling station 20 operates on the workpiece in the form of a continuous wire to produce the coil spring S. The supply of wire W is displaced by feed rolls 24 through a wire guide 26 and a block wire guide 28. The wire is continuously displaced generally parallel to the front face of panel 30 of the machine until it reaches the arbor 32. The front panel 30 of the machine extends outwardly from the plane of FIG. 1 toward the operator. The arbor 32 and the block wire guide 28 are mounted to a tool holder or chuck 40 which is mounted through the front panel 30 and clamped into position. A coiling point 34 contacts the wire as it emerges from in between the arbor 32 and the block guide 28 and deformably forces the wire into a generally helical shape. A pitch tool 36 is conventionally wedged at an angle to the wire thereby establishing the pitch of a plurality of successive loops or turns in the coil. When the spring reaches the desired number of turn or links, a cutting tool 50 in the form of a tension assembly having a projecting cutting blade 52 is actuated. The blade 52 is pivotally displaced from the upper left in the direction of the FIG. 1 arrow to sever the feed wire against the arbor 32 and thereby complete the fabrication of the coil spring S.

In conventional spring coiling machines, it is common to have a plurality of wire rolls 54, 54', 54'' each having a wire with different diameters, shapes and/or compositions so that for a given work order, a specific supply of wire can be selected and supplied to the coiling station 20. The feed paths from the wire rolls typically extend through generally parallel wire guide channels 60, 60', 60'' which are forwardly (axially) spaced from the front panel 30 of the machine adjacent the coiling station. The wire, which is selected for a given work order, is then fed from the specific wire guide 60, 60', 60'' to the block wire guide 28 for deformation to produce the coil spring. The invention is described for three wire rolls and associated paths and guides. The coiling machine may have two or more of such wire rolls and associated structures.

Figure 2:
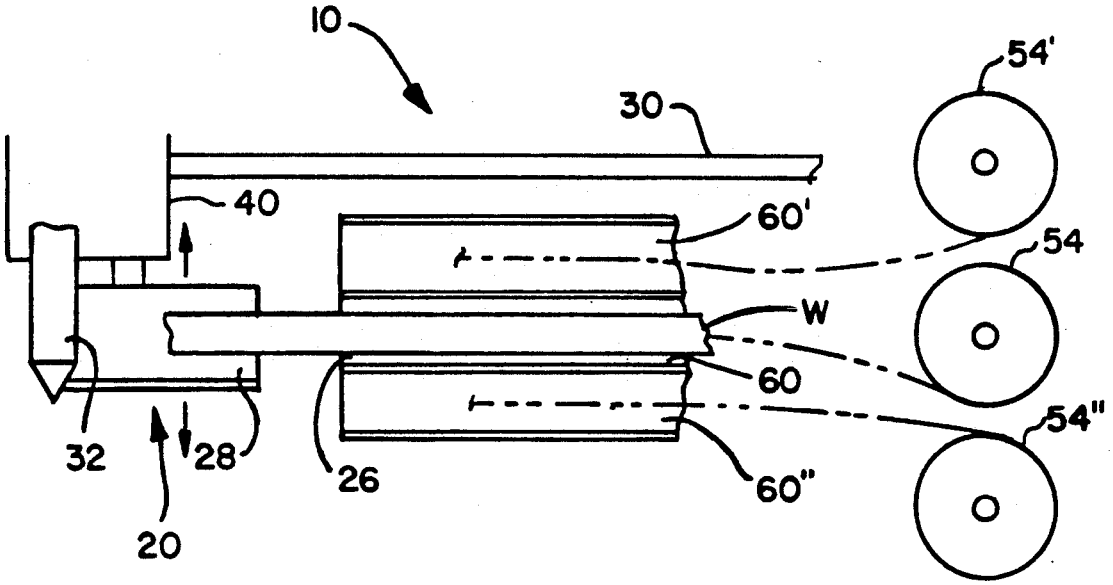
FIG. 2 is a top schematic view illustrating the wire feed path and the coiling station for the spring coiling machine of FIG. 1.

Because the feed locations of the various wire guides and paths have different input positions to the coiling station 20 according to the selected wire, it is necessary to specifically axially align the block wire guide 28 with the wire guide for the given selected wire supply. For example, as illustrated in FIG. 2, the block wire guide can be repositioned in the direction of the arrows to align the block wire guide 28 with guide channel 60' or 60''. Conventionally, the alignment adjustment is essentially undertaken by an eyesight type calibration by axially adjusting the chuck 40 before it is clamped to the panel 30.

Figure 3:
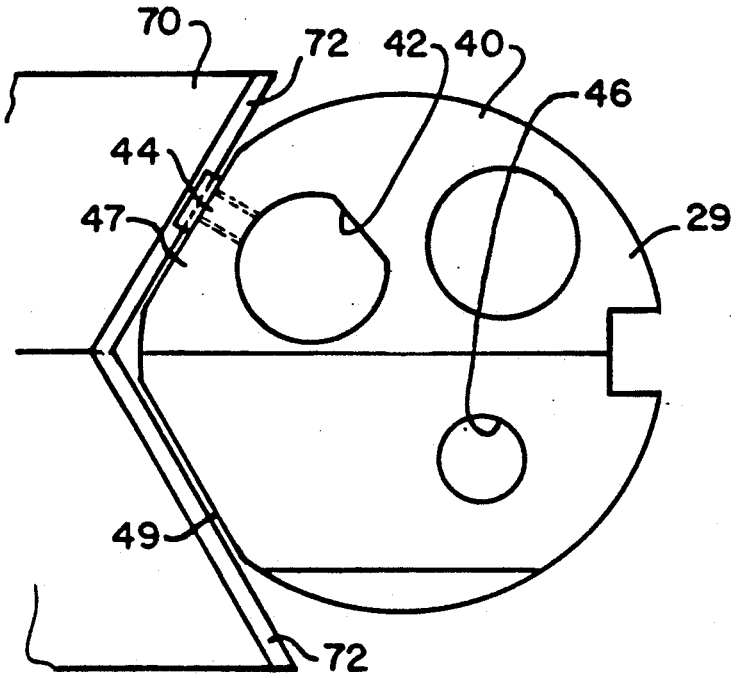
FIG. 3 is an enlarged fragmentary interior front view of a chuck assembly for the spring coiling machine of FIG. 1.
Figure 5:
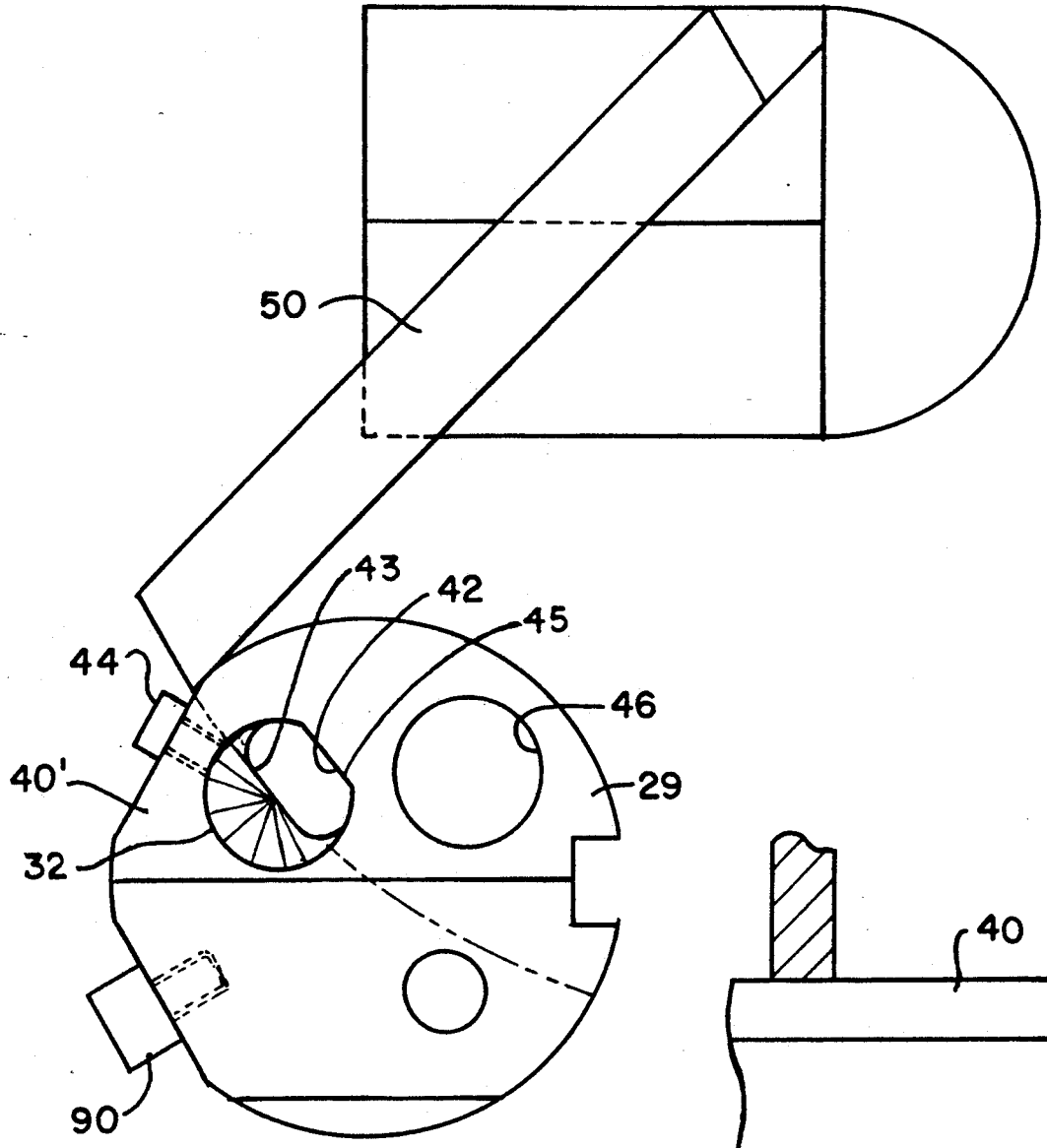
FIG. 5 is an enlarged fragmentary frontal view, partly broken away and partly in schematic, illustrating a second embodiment of a wire alignment apparatus in accordance with the present invention.

With additional reference to FIG. 3, the tool holder or chuck 40 has a D-shaped opening 42, which is defined by an integral (i.e., unsplit wall). The arbor is mounted to the chuck at a pre-established fixed angular orientation by insertion of the arbor (which has a complementary D-shaped cross section) in the D-shaped opening. The D-shape allows for absolute positioning of the relatively flat surface of the working end of the arbor, relative to the cutter angle, as shown in FIG. 5. Preferably, as shown in FIG. 5, the flat surface 43 of the working end of the arbor 32 is oriented substantially parallel to the flat portion of the wall defining the "D" shaped hole or opening 42 (i.e., which is also parallel to the flat surface 45 on the arbor 32 which registers with the flat wall portion of the hole 42). This eliminates the infinite number of possible rotational positions. This also prevent the arbor from rotating while in use. Even when an arbor is replaced or repaired, it is possible to exactly replicate the previous set-up. The arbor may be secured at a selected axial position by a set screw 44 or other means. (The axial positions referenced herein refer to the Z-axis position perpendicular to the plane of FIG. 1 or the distance from panel 30 of FIG. 2.)

The chuck also has a circular opening 46 which mounts the block wire guide 28. The block wire guide is ordinarily set at a pre-established fixed position from the front end face 29 of the chuck. The axial position of the block wire guide is determined by the axial position of the chuck. The axial position of the arbor is also partially a function of the axial position of the chuck.

The arbor 32 also may require axial positioning relative to the chuck or front panel 30 depending on a given work order and/or the wear condition of certain portions of the arbor. The axial position of the arbor 32 relative to the various other structures of the coiling station 20 is important both with respect to function and maximizing the useful life of the arbor which is manufactured from relatively expensive material. The free work end of the arbor cannot be displaced too far axially from the front panel or it will interfere with the spring coiling process. Likewise, the work end of the arbor cannot be positioned too close to the panel or there will not be sufficient arbor strength to effectuate the cutting. Since the arbor of the present invention is secured axially by the set screw 44 (not by the clamping of the chuck), independent axial adjustment of the arbor relative to the block wire guide can be achieved.

The block guide is aligned with the wire as follows. The chuck has a pair of oblique surfaces 47,49 which are engaged by a split V-shaped clamp 70 for securing the chuck at a fixed axial position relative to the front panel 30 of the machine. The chuck is conventionally adjusted to a selected position of a continuum of axial positions by simply positioning the chuck axially and then clamping the chuck in position. However, the present invention provides for discrete pre-established axial positions of the chuck as detailed hereafter.

Figure 4:
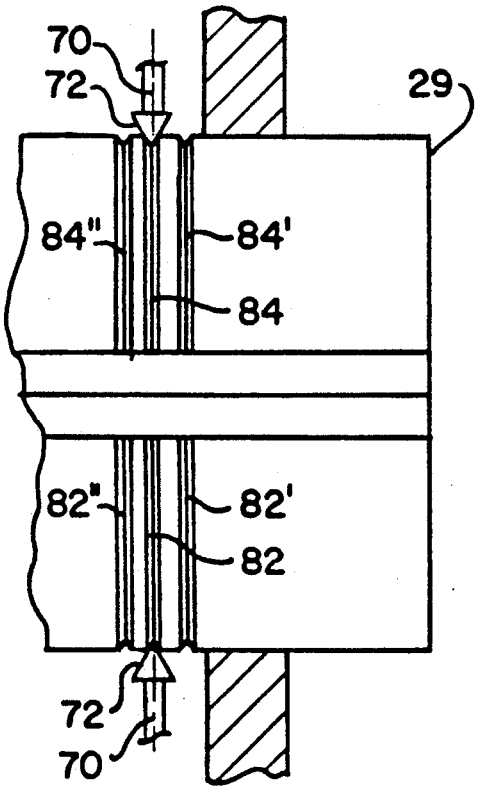
FIG. 4 is a side elevational view, partly broken away and partly in section, of a portion of the chuck assembly of FIG. 3.

With additional reference to FIG. 4, in accordance with one embodiment of the invention, the chuck 40 is affixed with a plurality of parallel grooves 82, 82', 82" and 84, 84', 84" which traverse surfaces 47 and 49, respectively. The grooves are axially spaced to correspond with the pre-established axial spacing of the wire guides 60, 60' and 60" adjacent the coiling station. The V-shaped clamps 70 which wedge the chuck in the fixed locked position further have a tongue 72 which is complementary with the grooves. The tongues 72 are seated in selected grooves in the clamped configuration to establish a discrete axial locked position of the chuck. An optimum accurate alignment of the block wire guide 28 with the appropriate wire guide 60, 60' or 60" is obtained for a given application. The chuck 40 is merely positioned so that the selected grooves will be engaged by the tongue 72 of the V-clamp to thereby define the correct aligned position. It will be appreciated that the chuck is thus positionable at discrete pre-established axial positions which define the proper alignment.

Figure 6:
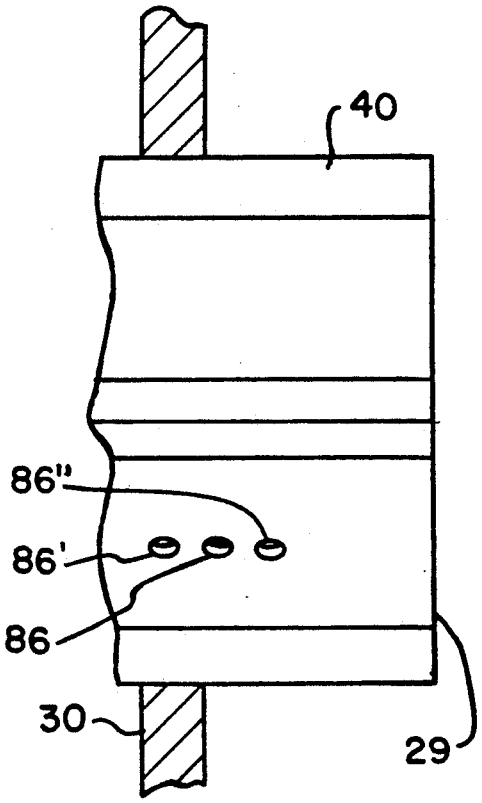
FIG. 6 is a fragmentary side sectional view of the wire alignment apparatus in accordance with the present invention.

In an alternative embodiment of the invention illustrated in FIGS. 5 and 6, the chuck 40' has a plurality of transverse bores 86, 86' and 86" which are axially spaced to correspond to the axial spacing of the wire guides 60, 60', 60" adjacent the coiling station 20. The bores open through oblique surface 49. Other locations are also possible. A discretely positionable stop in the form of a pin 90 or a block (not illustrated) is inserted into a selected bore. The chuck is then axially moved until the stop engages or interferes with the front panel 30 or other abutment structure which serves as a reference position, to thereby define the correct alignment position for a given wire guide 60, 60', 60". The chuck is then clamped in the locked position by conventional means.

Figure 7:
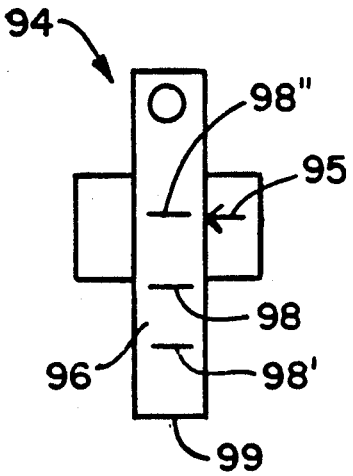
FIG. 7 is a fragmentary side elevational view of a third embodiment of a wire alignment apparatus in accordance with the present invention.

In another embodiment of the invention illustrated in FIG. 7, an adjustable stop 94 is fixedly mounted into a bore in the side of the chuck 40. The stop has a rule 96 which is linearly adjustable relative to a reference mark 95 to any number of positions 98, 98', 98". The positions are defined by the required axial spacing of the wire guides 60, 60', 60" of the chuck. After the wire supply is selected, the rule is then manually positioned to the desired setting wherein the rule end 99 engages the front panel 30 or other reference structure to define an optimum axial position of the chuck. The chuck is then clamped in the locked position by conventional means.

It should be appreciated that the foregoing wire alignment assemblies provide a very efficient and accurate means for effecting a proper alignment of the wire block guide with a wire guide and wire supply path for a given selected wire supply. Moreover, the relative position of the arbor and the block wire guide may be accurately set prior to securing and clamping the chuck in position. The arbor orientation and axial position relative to the block wire guide can thus be independently set to the optimal aligned position in a very efficient manner. Also, the axial position of the arbor can be readjusted without unclamping the chuck and without affecting the alignment of the block wire guide.

While preferred embodiments of the invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. The combination for use on a spring coiling machine, comprising:

a chuck having a body portion with side surfaces to be mounted in the coiling machine, a front face to be exposed when the chuck is so mounted, and a hole defined by a wall of non-uniform cross-section in the front face which extends along an axis into the body portion;

an elongated arbor having a first, working end and a body portion having a cross section sized so that the arbor body portion can register with and pass through the hole into the chuck body portion;

wherein the hole and arbor body portion are substantially cylindrical except for respective flat surfaces which mate uniquely when the arbor is in registry within the hole, and wherein the working end of the arbor has a flat working surface which is substantially parallel to said flat surface on the arbor body portion, such that the flat working surface of the arbor assumes a unique orientation relative to the axis of the hole when the arbor body portion is in said hole.

2. The combination of claim 1, wherein the hole in the chuck and the body portion of the arbor have a substantially "D" shaped cross section.

3. The combination of claim 1, wherein the extension of the hole into the body portion of the chuck, is formed by an integral internal wall.

* * * * *